US012276161B1

(12) United States Patent
Langford

(10) Patent No.: US 12,276,161 B1
(45) Date of Patent: Apr. 15, 2025

(54) LIFTING PLUG

(71) Applicant: VALLOUREC OIL AND GAS FRANCE, Aulnoye-Aymeries (FR)

(72) Inventor: Steve Langford, Meudon (FR)

(73) Assignee: VALLOUREC OIL AND GAS FRANCE, Aulnoye-aymeries (FR)

( * ) Notice: Subject to any disclaimer, the term of this patent is extended or adjusted under 35 U.S.C. 154(b) by 0 days.

(21) Appl. No.: 18/486,667

(22) Filed: Oct. 13, 2023

(51) Int. Cl.
*E21B 17/042* (2006.01)
*E21B 17/00* (2006.01)

(52) U.S. Cl.
CPC ..... *E21B 17/006* (2013.01); *E21B 17/0426* (2013.01)

(58) Field of Classification Search
CPC .... E21B 17/0426; E21B 17/006; F16L 15/08; F16L 15/06
See application file for complete search history.

(56) References Cited

U.S. PATENT DOCUMENTS 1,378,015 A * 5/1921 Erickson ..... F16L 15/08 285/392
2,104,799 A * 1/1938 Evans ..... F16L 15/04 285/332.2
2,140,467 A * 12/1938 Cargile ..... F16L 15/08 411/417
3,665,857 A * 5/1972 Radnich ..... F42B 39/00 102/481
5,035,180 A * 7/1991 Purcell ..... F42B 39/20 102/374
7,451,703 B1 * 11/2008 Dabiri ..... F42B 39/20 102/481
9,605,781 B2 * 3/2017 Beigneux ..... F16L 15/004
9,617,800 B2 * 4/2017 Zijsling ..... F16L 15/04
10,571,234 B1 * 2/2020 Morelli ..... F42B 39/20
2006/0016590 A1 * 1/2006 Hall ..... F16L 15/08 166/242.6
2013/0033035 A1 * 2/2013 Gallagher ..... E21B 17/042 285/332.2
2014/0166309 A1 * 6/2014 Benedict ..... F16L 15/08 166/380
2021/0396082 A1 12/2021 Deroubaix
2022/0010830 A1 * 1/2022 Wajnikonis ..... F16L 15/08
2022/0243845 A1 * 8/2022 Verger ..... F16L 15/08

FOREIGN PATENT DOCUMENTS

CN 107932184 A 4/2018

OTHER PUBLICATIONS

Extended European Search Report issued Mar. 13, 2024, in corresponding European Patent Application No. 23315387.3, 7 pages.

* cited by examiner

*Primary Examiner* — David Bochna
(74) *Attorney, Agent, or Firm* — Oblon, McClelland, Maier & Neustadt, L.L.P.

(57) ABSTRACT

A lifting plug for connection with a tubular member, the lifting plug including a tubular body including an externally threaded portion; one or more apertures extending through the tubular body within the externally threaded portion; and a flange at a first end of the tubular body for engagement with a lifting device.

10 Claims, 3 Drawing Sheets

LIFTING PLUG

BACKGROUND

This invention relates generally to lifting plugs. More specifically, although not exclusively, this invention relates to lifting plugs for connection with tubular members, e.g. drill pipe, casing, or production tubing, and that are configured to collect excess grease from the threaded portion of said tubular members, in use.

Drilling operations, whether in geothermal or hydrocarbon wells, utilise lengths of individual tubular members which are connected together via threaded portions at their ends to form a string, e.g. a drill string, casing string or production tubing string.

Often the tubular members are stored at the wellsite in a horizontal orientation, and must be lifted into a vertical orientation in order to be connected to the end of another tubular member already positioned in the well. Depending on the design of the threaded portion, a lifting plug may be threadedly connected with an end of the stored tubular member in order to provide a lifting surface for engagement with a lifting mechanism, e.g. an elevator, at the wellsite.

Prior to connecting the tubular members, grease is generally applied to the threads. It has been found that excess grease applied to the threaded portion of a tubular member prior to making a connection can, in some conditions, lead to a failure of the connection once it has been run into the well. The operator applying the grease at the wellsite often has little awareness of the quantity of grease being applied to the threaded portion and of the possible consequences in terms of connection failure.

BRIEF SUMMARY

It is therefore a first non-exclusive object of the invention to provide a means for controlling the amount of grease applied to a threaded portion of a tubular member. It is a further non-exclusive object of the invention to provide a means for removing or evacuating excess grease from a threaded portion of a tubular member prior to making a connection with a further tubular member.

In accordance with an aspect of the present invention, a lifting plug comprises: a tubular body comprising an externally threaded portion; one or more apertures extending through the tubular body within the externally threaded portion; and a flange at a first end of the tubular body for engagement with a lifting means.

The one or more apertures may be or may comprise grease evacuation apertures or grease weep apertures.

The lifting plug may be configured to connect or engage, e.g. threadedly, with a tubular member, e.g. a drill pipe, casing or production tubing. The lifting plug may be configured to provide a lifting point to a tubular member, in use.

The externally threaded portion may be or may comprise a male threaded portion.

The lifting plug may alternatively be known as, or be referred to as, a lift plug, a lift cap, a lifting cap, a nubbin, a lift nubbin, a lifting nubbin, a lift sub or a lifting sub.

The one or more apertures may extend through the thickness of the tubular body, e.g. from an exterior or outer surface to an interior or internal surface thereof.

The lifting plug may comprise a plurality of apertures extending through the tubular body within the externally threaded portion.

The lifting plug may comprise a plurality of apertures extending through the externally threaded portion.

One or more of the apertures may extend through one or more thread crests of the externally threaded portion.

Additionally or alternatively, one or more of the apertures may extend through one or more of the thread roots of the externally threaded portion.

The lifting plug may comprise one or more apertures extending through the thread crests of the externally threaded portion and one or more apertures extending through the thread roots of the externally threaded portion.

The lifting plug may comprise a plurality of apertures extending through the thread crests and/or thread roots of the externally threaded portion.

The apertures may be spaced from one another along the longitudinal axis of the tubular body.

The apertures may be spaced from one another along the externally threaded portion.

Two or more of the apertures may be aligned along the longitudinal axis of the tubular body.

Two or more of the apertures or aligned apertures may have a generally equal, equivalent or constant circumferential position on the body or externally threaded portion, e.g. along the longitudinal axis of the tubular body.

Two or more of the apertures or aligned apertures may have a generally equal, equivalent or constant position about the circumference or outer surface of the body or externally threaded portion, e.g. along the longitudinal axis of the tubular body.

The aligned apertures may form or define an aperture set.

The apertures of an aperture set may each extend through a respective thread crest of the externally threaded portion.

The apertures of an aperture set may each extend through a respective thread root of the externally threaded portion.

Adjacent aperture sets may alternate between apertures extending through the thread crests and the thread roots.

One or more of the apertures may have a circular cross-section, e.g. when viewed in a plane perpendicular to a longitudinal axis of the aperture.

Each of the plurality of apertures may be identical, e.g. other than their position on the externally threaded portion.

The lifting plug may comprise a plurality of aperture sets spaced around or about the circumference of the tubular body or externally threaded portion.

The lifting plug may comprise a plurality of aperture sets spaced around or about the outer surface of the tubular body or externally threaded portion.

The aperture sets may be evenly spaced around or about the circumference of the tubular body or externally threaded portion.

The aperture sets may be evenly spaced around or about the outer surface of the tubular body or externally threaded portion.

The lifting plug may comprise two aperture sets. The two aperture sets may be spaced 180 degrees apart.

The lifting plug may comprise three aperture sets. The three aperture sets may be spaced 120 degrees apart.

The lifting plug may comprise four aperture sets. The four aperture sets may be spaced 90 degrees apart.

The lifting plug may comprise five aperture sets. The five aperture sets may be spaced 72 degrees apart.

The lifting plug may comprise six aperture sets. The six aperture sets may be spaced 60 degrees apart.

The lifting plug may comprise any other suitable number of aperture sets.

The apertures may be spaced apart by at least one thread crest of the externally threaded portion. The apertures may be provided through every second thread crest.

The apertures may be spaced apart by at least one thread root of the externally threaded portion. The apertures may be provided through every second thread root.

Two or more of the apertures may be spaced from one another around or about a circumference of the tubular body.

Two or more of the apertures may be spaced from one another around or about the outer surface of the tubular body or externally threaded portion.

One or more or each of the apertures, e.g. a longitudinal axis thereof, may extend generally perpendicular to a longitudinal axis of the tubular body.

One or more of the apertures, e.g. a longitudinal axis thereof, may extend generally perpendicular to the thread crest and/or thread root through which they extend.

Each of the apertures, e.g. a longitudinal axis thereof, may extend generally perpendicular to the thread crest and/or thread root through which they extend.

One or more of the apertures, e.g. a longitudinal axis thereof, may extend generally perpendicular to an internal surface of the tubular body.

Each of the apertures, e.g. a longitudinal axis thereof, may extend generally perpendicular to an internal surface of the tubular body.

The externally threaded portion may have a single start thread. The externally threaded portion may comprise a single thread or a single threaded spine or helix.

The externally threaded portion may have a plural start thread. The externally threaded portion may comprise plural threads or a plural threaded spines or helices.

The externally threaded portion may comprise a plurality of thread crests spaced from one another along the externally threaded portion.

An outer diameter of the tubular body may decrease towards a free end.

The tubular body may be frustoconical.

The externally threaded portion may be frustoconical.

A major diameter and/or minor diameter of the externally threaded portion may decrease towards a free end of the tubular body.

The lifting plug may comprise an annular shoulder on the side of the flange from which the tubular body extends.

The lifting plug may comprise a lifting ring positioned over the body. The lifting ring may abut the flange or annular shoulder. The lifting ring may be removably attached to the flange or annular shoulder. The lifting ring may be configured to abut a free end of a tubular member, in use.

The tubular body may have a generally constant internal diameter along its length.

The lifting plug, flange and/or body may be formed of steel, e.g. martensitic steel.

Another aspect of the invention provides a method of forming or manufacturing a lifting plug as described above, the method comprising providing a lifting plug comprising a tubular body having an externally threaded portion and a flange at a first end of the body for engagement with a lifting means; and drilling through the tubular body within the externally threaded portion to form one or more grease evacuation apertures.

Another aspect of the invention provides a method of forming or manufacturing a lifting plug with a grease evacuation apertures, the method comprising providing a lifting plug comprising a tubular body having an externally threaded portion and a flange at a first end of the body for engagement with a lifting means; and drilling through the tubular body within the externally threaded portion to form one or more grease evacuation apertures.

The method may comprise locating or positioning the lifting plug within a lathe prior to drilling the one or more grease evacuation apertures.

The method may comprise drilling through the thickness of the tubular body, e.g. from an exterior or outer surface to an interior or internal surface thereof.

The method may comprise drilling through one or more crests and/or one or more roots of the externally threaded portion.

Another aspect of the invention provides a method of removing or evacuating excess grease from a female thread of a tubular member, e.g. casing, the method comprising threadedly engaging a lifting plug as described above with an end of the tubular member having a female thread; and unscrewing the lifting plug and removing it from the end of the tubular member.

The method may comprise threadedly engaging the lifting plug until a free end of the tubular member abuts the flange or lifting ring.

The method may comprise moving the tubular member via the lifting plug and connecting it to an existing tubular string prior to unscrewing the lifting plug.

The method may comprise first applying grease to a female thread at an end of the tubular member prior to threadedly engaging the lifting plug.

The method may comprise removing the grease from an internal surface of the tubular body, said grease having passed through the one or more apertures.

According to another aspect of the invention, a lifting plug comprises: a body comprising an externally threaded portion; a flange at a first end of the body for engagement with a lifting means; and a grease collection groove interrupting at least a part of the externally threaded portion.

The lifting plug may be configured to connect or engage, e.g. threadedly, with a tubular member, e.g. a drill pipe, casing or production tubing. The lifting plug may be configured to provide a lifting point to a tubular member, in use.

The externally threaded portion may be or may comprise a male threaded portion.

The lifting plug may alternatively be known as, or be referred to as, a lift plug, a lift cap, a lifting cap, a nubbin, a lift nubbin, a lifting nubbin, a lift sub or a lifting sub.

The body may have a free end at a second end, e.g. opposite the first end and/or flange.

The externally threaded portion may extend to the free end or second end of the body. The externally threaded portion may start or terminate at the free end or second end.

The externally threaded portion may have a starting point spaced from the free end or the second end of the body.

The grease collection groove may be elongate.

The grease collection groove may be configured to collect grease from a tubular member as the externally threaded portion is engaged with, or screwed into, a female thread, internally threaded portion or female threaded portion (hereinafter female thread) of said tubular member, in use.

The grease collection groove may be configured to collect grease from a tubular member as the externally threaded portion is engaged with, rotated relative to and or moved across a female thread of said tubular member, in use.

The grease collection groove may extend generally perpendicular to one or more threads of the externally threaded portion.

The grease collection groove may extend generally perpendicular to one or more thread crests or one or more thread flanks of the externally threaded portion.

The grease collection groove may interrupt or intersect one or more threads of the externally threaded portion.

The grease collection groove may interrupt or intersect one or more passes of a single thread of the threaded portion.

The grease collection groove may interrupt or intersect one or more thread crests of the externally threaded portion.

The grease collection groove may interrupt or intersect the threads of the entire externally threaded portion.

The grease collection groove may interrupt or intersect all passes of a single thread of the externally threaded portion.

The grease collection groove may interrupt or intersect all thread crests of the externally threaded portion.

The grease collection groove may interrupt, intersect or extend across the entire externally threaded portion.

The grease collection groove may extend across one or more threads of the externally threaded portion.

The grease collection groove may cut across or cut through one or more threads or thread crests of the externally threaded portion.

The grease collection groove may cut across or cut through one or more passes of a single thread of the externally threaded portion.

The grease collection groove may cut across or cut through all threads or thread crests of the externally threaded portion.

The grease collection groove may cut across or cut through all passes of a single thread of the externally threaded portion.

The grease collection groove may intersect, pass through, cut across or cut through at least part of the externally threaded portion or one or more threads or thread crests thereof.

A central axis of the grease collection groove may have a generally constant circumferential position on or around the body, e.g. an outer surface thereof, along the length of the grease collection groove.

The grease collection groove may be generally straight or linear.

A central axis of the grease collection groove may have a varying circumferential position on or around the body, e.g. an outer surface thereof, or externally threaded portion along the length of the grease collection groove.

The grease collection groove may be non-linear, for example curved or tortuous.

The grease collection groove may extend parallel to a longitudinal axis of the lifting plug or body.

The grease collection groove may extend generally or substantially parallel to a longitudinal axis of the lifting plug or body.

The grease collection groove may be inclined with respect to a longitudinal axis of the lifting plug or body.

The interruption of the grease collection groove with the externally threaded portion may define or describe a discontinuity or break in the male thread or one or more threads or thread crests of the externally threaded portion.

The grease collection groove may comprise an interruption or intersection of two or more adjacent threads or thread crests of the externally threaded portion.

The grease collection groove may comprise a plurality of interruptions or intersections along the externally threaded portion. The plurality of interruptions or intersections may be spaced along the externally threaded portion or an outer surface of the body.

The grease collection groove may comprise a plurality of interruptions or intersections of the threads or thread crests of the externally threaded portion.

The grease collection groove may be recessed into the body, e.g. an outer surface thereof, in the externally threaded portion.

The grease collection groove may be recessed into an outer surface of the body, e.g. in the externally threaded portion.

The grease collection groove may be recessed relative to a thread root, e.g. of the threads, of the externally threaded portion.

The grease collection groove may define or describe a channel.

The grease collection groove may have a base or floor. The base or floor may be flat or planar.

One or more of the side walls of the grease collection groove may comprise an undercut or overhang. A trailing side wall of the grease collection groove may comprise an undercut or overhang. The trailing side may be the trailing side during tightening of the lifting plug within a threaded portion of a tubular member, in use.

One or more of the side walls of the grease collection groove may extend at an angle of between 40 and 70 degrees with respect to the base or floor, for example between 45 and 65 degrees or between 50 and 60 degrees. One or more of the side walls of the grease collection groove may extend at an angle of 60 degrees with respect to the base or floor.

A trailing side wall of the grease collection groove may extend at an angle of between 40 and 70 degrees with respect to the base or floor, for example between 45 and 65 degrees or between 50 and 60 degrees. The trailing side wall of the grease collection groove may extend at an angle of 60 degrees with respect to the base or floor.

One or more of the side walls of the grease collection groove may extend at an angle of between 20 and 40 degrees, for example between 25 and 35 degrees or 30 degrees, with respect to the normal to a tangent at an outer upper end of the side wall.

A trailing side wall of the grease collection groove may extend at an angle of between 20 and 40 degrees, for example between 25 and 35 degrees or 30 degrees, with respect to the normal to a tangent at an outer upper end of the side wall.

The grease collection groove may have a dovetail shape or profile, e.g. when viewed in cross-section.

It will be appreciated that the provision of an undercut or overhang may improve the collection of grease within the grease collection groove from a female thread of a tubular member, in use, as the side walls may provide a scooping or scraping action as they are moved relative to or across the female thread.

One or more of the side walls of the grease collection groove may extend at an angle of 90 degrees with respect to the base or floor. One or more of the side walls of the grease collection groove may be perpendicular to the base or floor.

One or more of the side walls of the grease collection groove may extend at an angle of 90 degrees with respect to the normal to a tangent at an outer upper end of the side wall. One or more of the side walls of the grease collection groove may perpendicular to the normal to a tangent at an outer upper end of the side wall.

The grease collection groove, or base or floor thereof, may have a width, e.g. a maximum width, of between 9 and 16 millimetres, for example between 10 and 14 millimetres, between 11 and 13 millimetres. The grease collection groove, or base or floor thereof, may have a width, e.g. a maximum width, of between 12 and 13 millimetres.

The grease collection groove may have a depth of between 0.5 and 2.5 millimetres, e.g. with respect to an outer surface of the body or a thread root of the threads of the externally threaded portion, for example between 1 and 2 millimetres. The grease collection groove may have a depth of between 1.5 and 2 millimetres, e.g. with respect to an outer surface of the body or a thread root of the threads of the externally threaded portion.

The lifting plug may comprise a plurality of grease collection grooves, e.g. as described above.

The plurality of grease collection grooves may be spaced along the body, e.g. the outer surface thereof, or the externally threaded portion.

The plurality of grease collection grooves may be spaced, e.g. from one another, around or about the circumference of the body or the externally threaded portion.

The plurality of grease collection grooves may be spaced, e.g. from one another, around or about the outer surface of the body or the externally threaded portion Each of the grease collection grooves may be identical, e.g. other than their position along the body or the externally threaded portion.

Each of the grease collection grooves may be identical, e.g. other than their position around or about the circumference or outer surface of the body or the externally threaded portion.

The plurality of grease collection grooves may be evenly spaced around or about the circumference or outer surface of the body or the externally threaded portion.

A central axis of each of the grease collection grooves may be spaced or evenly spaced around or about the circumference or outer surface of the body or the externally threaded portion.

The lifting plug may comprise two grease collection grooves. The two grease collection grooves may be spaced 180 degrees apart.

The lifting plug may comprise three grease collection grooves. The three grease collection grooves may be spaced 120 degrees apart.

The lifting plug may comprise four grease collection grooves. The four grease collection grooves may be spaced 90 degrees apart.

The lifting plug may comprise five grease collection grooves. The five grease collection grooves may be spaced 72 degrees apart.

The lifting plug may comprise six grease collection grooves. The six grease collection grooves may be spaced 60 degrees apart.

The lifting plug may comprise any other suitable number of grease collection grooves.

One or more grease collection groove(s) may terminate at a free end or second end of the body, e.g. the outer surface thereof, or externally threaded portion.

One or more grease collection groove(s) may be open at a free end or second end of the body, e.g. the outer surface thereof, or externally threaded portion.

The externally threaded portion may have a single start thread. The externally threaded portion may comprise a single thread or a single threaded spine or helix.

The externally threaded portion may have a plural start thread. The externally threaded portion may comprise plural threads or a plural threaded spines or helices.

The externally threaded portion may comprise a single thread crest, e.g. formed on or extending across an outer surface of the body.

The externally threaded portion may comprise a plurality of thread crests spaced from one another along the externally threaded portion.

The externally threaded portion may be formed on an outer surface of the body.

An outer diameter of the body may decrease towards a free end.

The body may be frustoconical.

The externally threaded portion may be frustoconical.

A major diameter and/or minor diameter of the externally threaded portion may decrease towards a free end of the body.

The lifting plug may comprise an annular shoulder on the side of the flange from which the body extends.

The lifting plug may comprise a lifting ring positioned over the body. The lifting ring may abut the flange or annular shoulder. The lifting ring may be removably attached to the flange or annular shoulder. The lifting ring may be configured to abut a free end of a tubular member, in use.

The body may be tubular.

The body may have a generally constant internal diameter along its length.

The lifting plug, flange and/or body may be formed of steel, e.g. martensitic steel.

Another aspect of the invention provides a method of forming or manufacturing a lifting plug as described above, the method comprising providing a lifting plug comprising a body having an externally threaded portion and a flange at a first end of the body for engagement with a lifting means; and machining a groove interrupting at least a part of the externally threaded portion.

Another aspect of the invention provides a method of forming or manufacturing a lifting plug with a grease collection groove, the method comprising providing a lifting plug comprising a body having an externally threaded portion and a flange at a first end of the body for engagement with a lifting means; and machining a groove interrupting at least a part of the externally threaded portion.

The method may comprise locating the lifting plug within a lathe prior to machining the groove.

The method may comprise moving a router across at least portion of the externally threaded portion or body to form the groove.

The method may comprise moving a mill across at least portion of the externally threaded portion or body to form the groove.

The method may comprise moving the router or mill across the externally threaded portion or body to a free end of the body, opposite the flange. The method may comprise moving the router or mill beyond the free end of the body.

The method may comprise rotating the lifting plug about its longitudinal axis and repeating the process to machine a further groove. The method may comprise rotating the lifting plug, e.g. by operating the lathe.

Another aspect of the invention provides a method of removing excess grease from a female thread of a tubular member, e.g. casing, the method comprising threadedly engaging a lifting plug as described above with an end of the tubular member having a female thread; and unscrewing the lifting plug and removing it from the end of the tubular member.

The method may comprise threadedly engaging the lifting plug until a free end of the tubular member abuts the flange or lifting ring.

The method may comprise moving the tubular member via the lifting plug and connecting it to an existing tubular string prior to unscrewing the lifting plug.

The method may comprise first applying grease to a female thread at an end of the tubular member prior to threadedly engaging the lifting plug.

The method may comprise removing the collected grease from the grease collection groove after unscrewing the lifting plug from the tubular member.

According to another aspect of the invention, a lifting plug comprises: a tubular body comprising an externally threaded portion; a flange at a first end of the body for engagement with a lifting means; one or more apertures extending through the tubular body within the externally threaded portion and a grease collection groove interrupting at least a part of the externally threaded portion.

For the avoidance of doubt, any of the features described herein apply equally to any aspect of the invention. For example, it will be appreciated that the lifting plug may comprise one or more grease collection grooves and one or more grease evacuation apertures as described above.

Another aspect of the invention provides a computer program element comprising and/or describing and/or defining a three-dimensional design for use with a simulation means or a three-dimensional additive or subtractive manufacturing means or device, e.g. a three-dimensional printer or CNC machine, the three-dimensional design comprising an embodiment of the lifting plug described above.

A further aspect of the invention provides a computer program element comprising computer readable program code means for causing a processor to execute a procedure to implement one or more steps of the aforementioned method.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments of the invention will now be described by way of example only with reference to the accompanying drawings in which.

DETAILED DESCRIPTION

Figure 1:
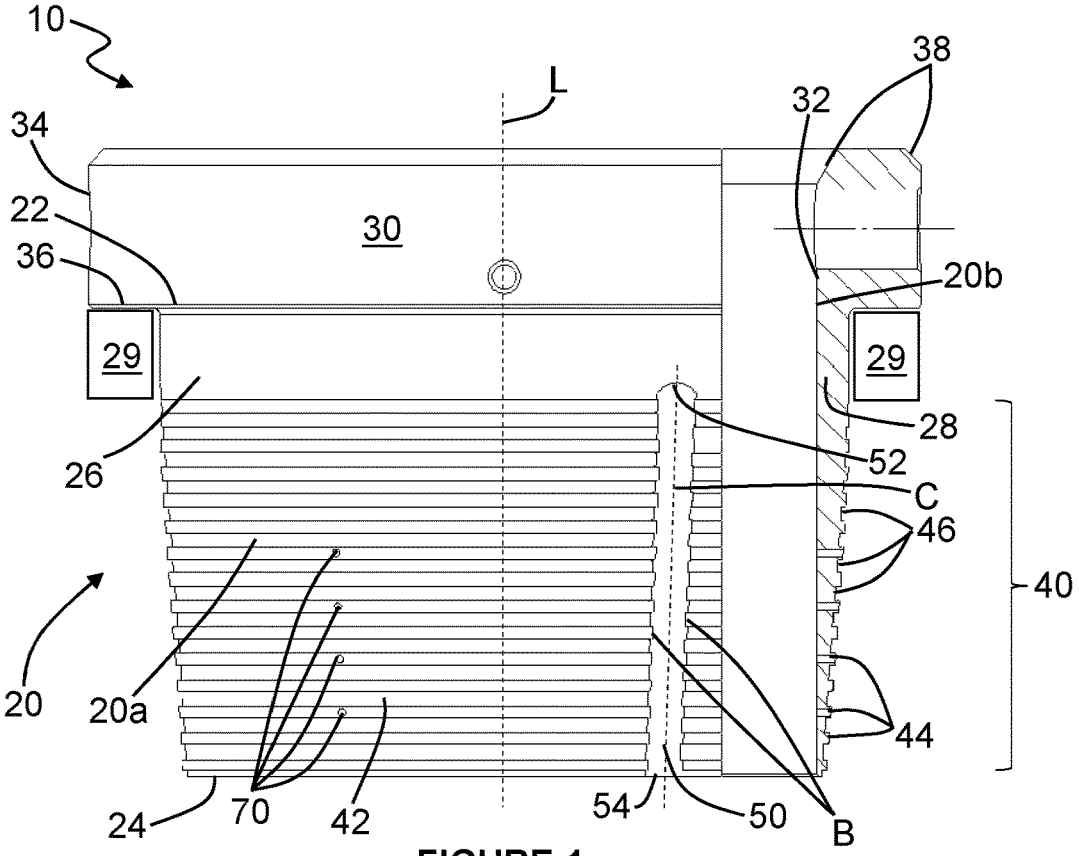
FIG. 1 is a part cutaway view of a lifting plug in accordance with an embodiment of the invention.

Referring now to FIG. 1, there is shown a lifting plug 10 configured to threadedly connect with, and provide a lifting point to, a tubular member, e.g. a drill pipe, casing or production tubing (not shown), in use. The lifting plug 10 has a tubular body 20 extending along a longitudinal axis L between a first end 22 connected with an annular flange 30 and a free end at a second end 24. The flange 30 is configured to engage with a lifting means, e.g. an elevator of a drilling rig, in use.

In the arrangement shown in FIG. 1, an externally threaded portion 40 extends across a part of an outer surface 20*a* of the tubular body 20 from the second end 24 and is configured to threadedly engage with a female thread of a tubular member, in use. However, it will be appreciated that the externally threaded portion 40 need not start from the second end 24, and instead could have a starting point spaced from the second end 24. As will be described in greater detail below, an elongate grease collection groove 50 interrupts the externally threaded portion 40 and is configured to collect grease from the female thread of a tubular member as the externally threaded portion 40 is engaged with and rotated relative to a female thread of said tubular member, in use.

Furthermore, a plurality of apertures 70 extend through the tubular body 20 within the externally threaded portion 40 and are configured to evacuate grease from the female thread of a tubular member as the externally threaded portion 40 is engaged and rotated relative to a female thread of said tubular member, in use.

The tubular body 20 has a constant inner diameter D (FIG. 2) defined by an inner surface 20*b*. A first part 26 of the outer surface 20*a* of the tubular body 20 extends between the flange 30 and the externally threaded portion 40, has a generally constant outer diameter and is free of threads. A lifting ring 29 is positioned over the first part 26, such that the first part is not visible. The lifting ring 29 is removably attached to the flange 30 in this embodiment by one or more fixings, e.g. bolts or screws. It will also be appreciated that the lifting ring 29 may not be required. The tubular body 20 is generally frustoconical in the externally threaded portion 40 that extends from the first part 26 to the second end 24. The wall thickness 28 of the tubular body 20 is generally constant within the first part 26 and decreases throughout the externally threaded portion 40 towards the second end 24, as is shown by the cutaway portion of FIGS. 1 and 4.

The flange 30 is formed integrally with the tubular body 20 in this embodiment. However, it will be appreciated that the flange 30 may instead be removably connected to the tubular body 20, e.g. by one or more fixings or screws. The flange 30 has an inner diameter defined by a radially inner surface 32 generally equal to the inner diameter D of the tubular body 20 such that the surfaces 20*b* and 32 are contiguous. The flange 30 also has a radially outer surface 34 defining an outer diameter greater than the outer diameter of the first part 26 of the tubular body 20.

As a result, an annular shoulder 36 is provided adjacent the first end 22, e.g. on the side from which the tubular body 20 extends, and has a width in a radial direction generally equivalent to the difference between the diameter defined by the outer surface 34 and the outer diameter of the first part 26 of the tubular body 20. The lifting ring 29 abuts the annular shoulder 36 and has a width in a radial direction generally equal to it. The lifting ring 29 is configured to engage with a lifting means, in use. The upper corners of the flange 30 are chamfered as shown at 38. The lifting ring 29 is also configured to abut a free end or end surface of a female connection, e.g. of a drill string or casing string, in use.

The externally threaded portion 40 includes a single start male thread 42 comprising a single helix extending in a plurality of passes around the outer surface 20*a* of the tubular body 20. In the arrangement of FIG. 1, the thread 42 starts at the second end 24 of the body 20 and terminates at the end of the externally threaded portion 40 adjacent the first part 26 of the tubular body 20. The thread 42 defines a plurality of thread crests 44 spaced by a plurality of thread roots 46 arranged along the externally threaded portion 40. As is shown in the cutaway portion of FIGS. 1 and 4, the thread crests 44 have a generally square or rectangular profile. Although not shown in FIG. 1, it will be appreciated that the thread crests 44 may instead have a dovetail profile.

Figure 2:
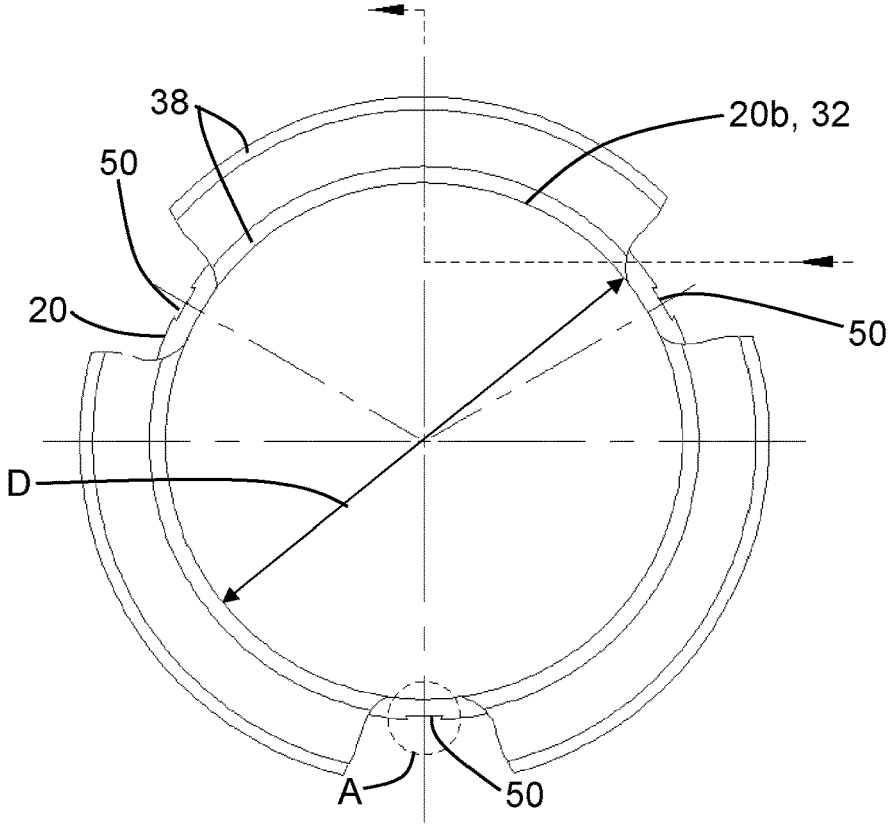
FIG. 2 is a part cutaway plan view of the lifting plug of FIG. 1.
Figure 3:
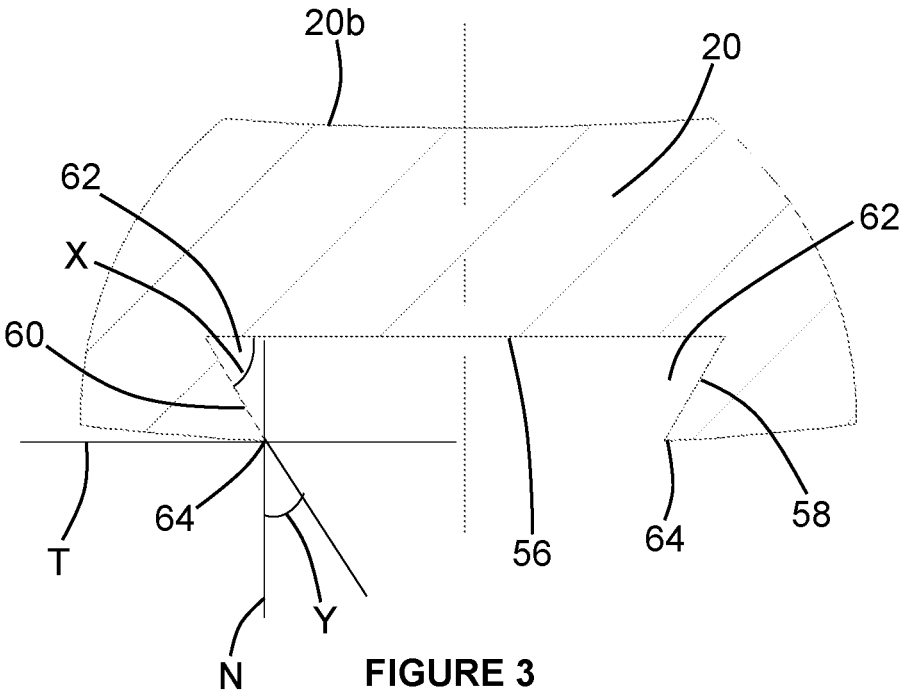
FIG. 3 is a detail view of region A of FIG. 2.

Referring now to FIGS. 1 to 3, the lifting plug 10 has three elongate grease collection grooves 50 evenly spaced around or about the outer surface 20*a* or circumference of the tubular body 20, i.e. spaced 120 degrees apart (as shown in FIG. 2 in particular). Each grease collection groove 50 is generally straight, having a central axis C that has a generally constant circumferential position on or about the outer surface of the tubular body 20.

Each grease collection groove 50 has a first end 52 located within the first part 26 of the tubular body 20 and a second open end 54 at the second end 24 of the tubular body 20. As the grease collection groove 50 is open at the second end 24 of the tubular body 20, removal of collected grease is simplified as a tool or cleaning implement can be moved along the groove 50 from the first end 52 towards the second open end 54 and any collected grease can be evacuated at the second open end 54.

Each grease collection groove 50 extends through or across the entire externally threaded portion 40 and interrupts all passes or thread crests 44 of the thread 42 in this embodiment. The grease collection groove 50 extends generally perpendicular to the thread 42 or thread crests 44 of the externally threaded portion 40. Furthermore, the interruption of the externally threaded portion 40 by the grease collection groove 50 defines a discontinuity or break B in the thread 42 throughout the externally threaded portion 40.

As is shown in FIGS. 2 and 3 in particular, the grease collection groove 50 is recessed into the outer surface 20*b* of the tubular body 20 in the externally threaded portion 40 and describes a channel having a generally flat base 56 and a pair of opposed side walls 58, 60. The base 56 of the grease collection groove 50 is recessed with respect to the first part 26 at the first end 52 and is recessed with respect to the thread roots 46 of the externally threaded portion 40.

One of the side walls 58 may be referred to as a trailing side wall, and the other of the side walls 60 may be referred to as a leading side wall. Referring to FIG. 2 in particular, the trailing side wall 58 is the trailing side during tightening of the lifting plug 10 within a tubular member, i.e. clockwise rotation of the lifting plug 10 as shown in FIG. 2, in use.

In the present embodiment, each of the side walls 58, 60 includes an undercut or overhang 62 (hereinafter undercut). Furthermore, each of the side walls 58, 60 extends at an angle X of 60 degrees with respect to the flat base 56. Additionally, each of the side walls 58, 60 extends at an angle Y of 30 degrees with respect to the normal N to a tangent T at an outer upper end 64 of each side wall 58, 60.

In the case of a flat base 56 as per the present embodiment, each of the side walls 58, 60 extends at an angle Y of 30 degrees with respect to the normal N to the base 56. The provision of an undercut 62 improves the collection of grease within the grease collection groove 50 from the female thread of a tubular member, in use, as the side walls 58, 60 provide a scooping or scraping action as they are moved relative to or across the female thread.

Although not shown in FIG. 1, in some embodiments each of the side walls 58, 60 may be absent an undercut or overhang. In such embodiments, each of the side walls 58, 60 extends at an angle X of 90 degrees with respect to the flat base 56. Additionally, each of the side walls 58, 60 extends at an angle Y of 90 degrees with respect to the normal N to a tangent T at an outer upper end 64 of each side wall 58, 60. In the case of a flat base 56 as per the present embodiment, each of the side walls 58, 60 may extend at an angle Y of 90 degrees with respect to the normal N to the base 56.

Figure 4:
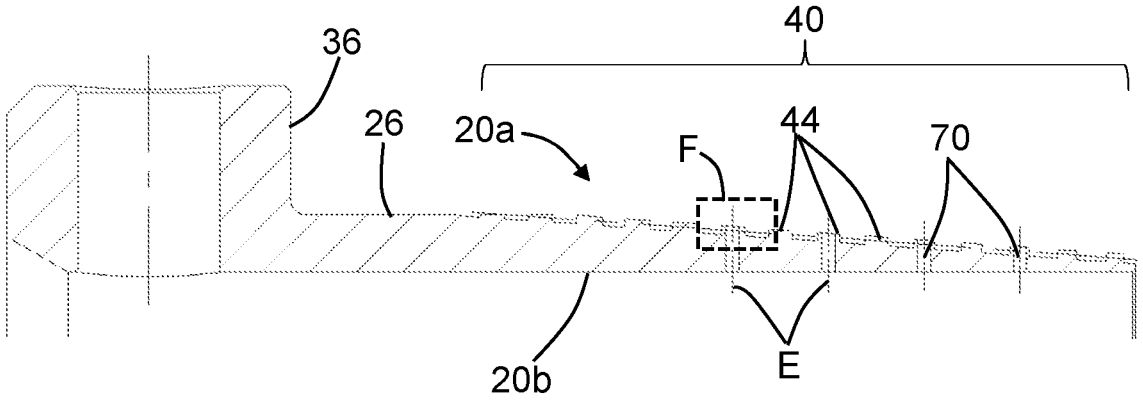
FIG. 4 is a detail view of the cutaway portion of FIG. 1.
Figure 5:
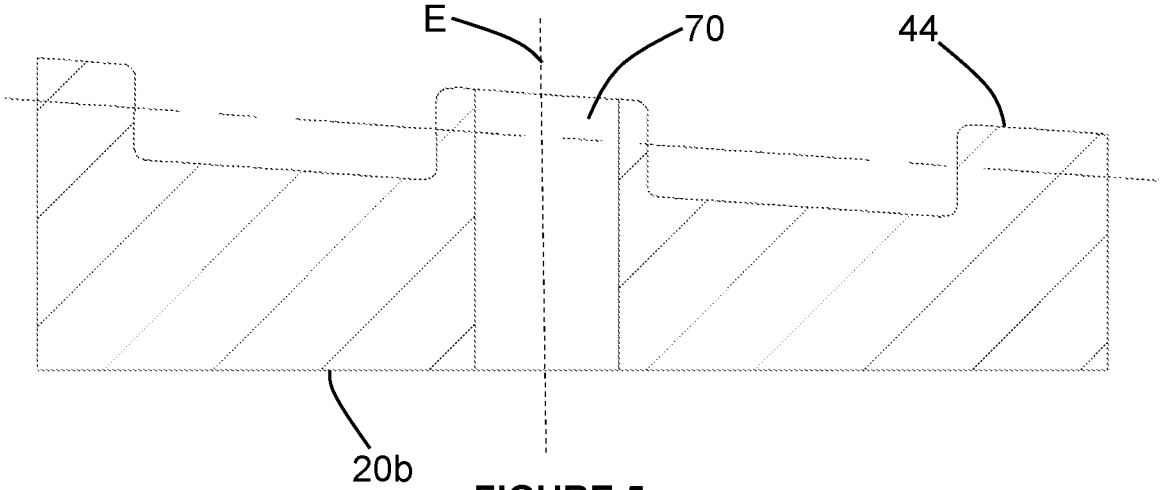
FIG. 5 is a detail view of region F of FIG. 4.

Referring now to FIGS. 1, 4 and 5, the lifting plug 10 has four apertures 70 extending through the tubular body 20 within the externally threaded portion 40. The apertures 70 shown in FIGS. 1, 4 and 5 form an aperture set and, although not shown in the Figures, the present embodiment includes six such sets thereby providing a total of 24 apertures 70 extending through the tubular body 20. The aperture sets are evenly spaced between the three grease collection grooves 50. It will be appreciated that different grease collection groove/aperture arrangements are envisaged. Each of the apertures 70 extends through the thickness of the tubular body 20 from the outer surface 20*a* through to the inner surface 20*b*.

The apertures 70 each have longitudinal axis E that extends generally perpendicular to the inner surface 20*b* of the tubular body 20, and generally perpendicular to the longitudinal axis L of the tubular body 20. Each of the apertures 70 has a generally circular cross section when viewed in a plane perpendicular to its longitudinal axis E.

The apertures 70 each extend through a respective thread crest 44 and are spaced from one another along the longitudinal axis L by a further thread crest 44. In the present embodiment, the apertures 70 are aligned along the longitudinal axis L of the tubular body 20, such that they have the same circumferential position around or about the outer surface 20*a* thereof. It will be appreciated that there may be an alternative number of aperture sets arranged around the circumference of, or outer surface 20*a* of, the body 20 or externally threaded portion 40. Furthermore, it will be appreciated that the apertures 70 of one or more aperture sets may each extend through a respective thread root 46 and are spaced from one another along the longitudinal axis L by a further thread root 46. Adjacent aperture sets may alternate between extending through thread crests 44 and thread roots 46.

In use, the lifting plug 10 is threadedly engaged with an end of a tubular member (not shown) having a female thread and is rotated clockwise based on the view shown in FIG. 2. Rotation of the lifting plug 10 causes the externally threaded portion 40, and thread 42, to engage with the female thread and move across and relative thereto. As the lifting plug 10 is rotated, a portion of excess grease that has been applied to the female thread will be scraped and collected within the grease collection groove 50 and another portion will be evacuated through the apertures 70.

Once the tubular member has been moved and connected to an existing tubular string, the lifting plug 10 is unscrewed and removed from the tubular member and the grease can be removed from the grease collection groove 50. Furthermore, grease evacuated through the apertures 70 can be removed from the inner surface 20*b* of the tubular body 20. In such a case, the female thread of the tubular member no longer contains excess grease that may lead to connection failure.

It will be appreciated by those skilled in the art that several variations to the aforementioned embodiments are envisaged without departing from the scope of the invention.

It will also be appreciated by those skilled in the art that any number of combinations of the aforementioned features and/or those shown in the appended drawings provide clear advantages over the prior art and are therefore within the scope of the invention described herein.

The invention claimed is:

1. A lifting plug for connection with a tubular member, the lifting plug comprising:

a tubular body comprising an externally threaded portion;

a plurality of apertures extending through thread crests of the externally threaded portion of the tubular body; and a flange at a first end of the tubular body for engagement with a lifting device, wherein the apertures are spaced from one another along the longitudinal axis of the tubular body.

2. The lifting plug according to claim 1, wherein the one or more apertures extend through the thickness of the tubular body from an exterior to an interior thereof.

3. The lifting plug according to claim 1, wherein two or more of the apertures are aligned along the longitudinal axis of the tubular body.

4. The lifting plug according to claim 3, wherein the aligned apertures form an aperture set.

5. The lifting plug according to claim 4, comprising a plurality of aperture sets spaced around the circumference of the externally threaded portion.

6. The lifting plug according to claim 5, wherein the aperture sets are evenly spaced around the circumference of the externally threaded portion.

7. The lifting plug according to claim 3, wherein the apertures are spaced apart by at least one thread crest of the externally threaded portion.

8. The lifting plug according to claim 1, wherein one or more apertures extend through one or more thread roots of the externally threaded portion.

9. The lifting plug according to claim 1, wherein one or more of the apertures extends generally perpendicular to a longitudinal axis of the tubular body.

10. A method of manufacturing a lifting plug with one or more grease evacuation apertures, the method comprising:

providing a lifting plug comprising a tubular body having an externally threaded portion and a flange at a first end of the body for engagement with a lifting device; and drilling through the tubular body within the externally threaded portion to form a plurality of grease evacuation apertures that extend through thread crests of the externally threaded portion the tubular body, wherein the apertures are spaced from one another along the longitudinal axis of the tubular body.

* * * * *